US006588591B1

(12) United States Patent
Schabert et al.

(10) Patent No.: US 6,588,591 B1
(45) **Date of Patent: *Jul. 8, 2003**

(54) RECLOSEABLE PACK

(75) Inventors: Andreas Schabert, Seevetal (DE); Günther Schultz, Hamburg (DE)

(73) Assignee: Beiersdorf AG, Hamburg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 267 days.

(21) Appl. No.: 09/205,250

(22) Filed: Dec. 4, 1998

(30) Foreign Application Priority Data

Dec. 13, 1997 (DE) ..... 197 55 502

(51) Int. Cl.[7] ..... B65D 73/00; B65D 27/22; B65D 27/34

(52) U.S. Cl. ..... 206/441; 206/484; 229/84; 229/313

(58) Field of Search ..... 206/440, 441, 206/461, 484, 806; 229/84, 92.8, 313, 71

(56) References Cited

U.S. PATENT DOCUMENTS

| | | | | |
|---|---|---|---|---|
| 3,008,837 A | * | 11/1961 | Kaplan | 206/484 X |
| 3,266,714 A | * | 8/1966 | Heuberger | 229/92.8 |
| 3,486,615 A | * | 12/1969 | De Woskin | 206/461 X |
| 3,698,549 A | * | 10/1972 | Glassman | 206/440 |
| 3,724,651 A | * | 4/1973 | Link | 206/440 X |
| 3,773,251 A | * | 11/1973 | Hadick | 229/313 X |
| 4,666,040 A | * | 5/1987 | Murata | 206/441 |
| 5,133,477 A | * | 7/1992 | Etheredge, III et al. | 206/441 X |
| 5,133,496 A | * | 7/1992 | Davidson et al. | 229/92.8 |
| 5,609,253 A | | 3/1997 | Goade, Sr. | |
| 5,656,282 A | | 8/1997 | Cook et al. | |
| 5,695,456 A | * | 12/1997 | Cartmell et al. | 206/440 X |

FOREIGN PATENT DOCUMENTS

| | | |
|---|---|---|
| DE | 7711320 | 10/1978 |
| DE | 9202604 | 5/1992 |
| DE | 9216377 | 5/1993 |
| DE | 9202882 | 8/1993 |
| DE | 29507575 | 10/1995 |
| DE | 19532162 | 3/1997 |
| DE | 29606678 | 9/1997 |
| EP | 0553413 | 8/1993 |
| EP | 0559443 | 9/1993 |
| EP | 0697340 | 2/1996 |

OTHER PUBLICATIONS

Derwent Abstract of DE 19532162 (Mar. 6, 1997).
Derwent Abstract of DE 29606678 (Sep. 25, 1997).
Derwent Abstract of EP 0553413 (Aug. 4, 1993).
Derwent Abstract of EP 0697340 (Feb. 21, 1996).

* cited by examiner

*Primary Examiner*—Bryon P. Gehman
(74) *Attorney, Agent, or Firm*—Norris McLaughlin & Marcus

(57) ABSTRACT

Recloseable dustproof pack 10 with tamperproof seal, which is intended for packaging low-thickness products 8 and is formed from cardboard, paperboard or a similar material, comprising a front side wall 1 and rear side wall 2 which are essentially rectangular and have essentially the same dimensions, it being the case that the front side wall 1 and the rear side wall 2 are arranged so as to be located one above the other, on a total of three sides the respective edge regions 41, 42, 43 are adhesively bonded to one another by having an adhesive coating applied over their surfaces, and the front side wall 1 and the rear side wall 2 are connected to one another on the non-adhesively-bonded side via a folding line 3, this resulting in a pocket 5 which is closed off towards the outside, and it being the case that provided in the front side wall 1 is a flap 11 which is articulated on the front side wall 1 by means of a second folding line 6 and of which the remaining edges are joined to the surrounding region of the front side wall 1 by means of weakening lines 12, 13, 14.

15 Claims, 4 Drawing Sheets

RECLOSEABLE PACK

Figure 1:
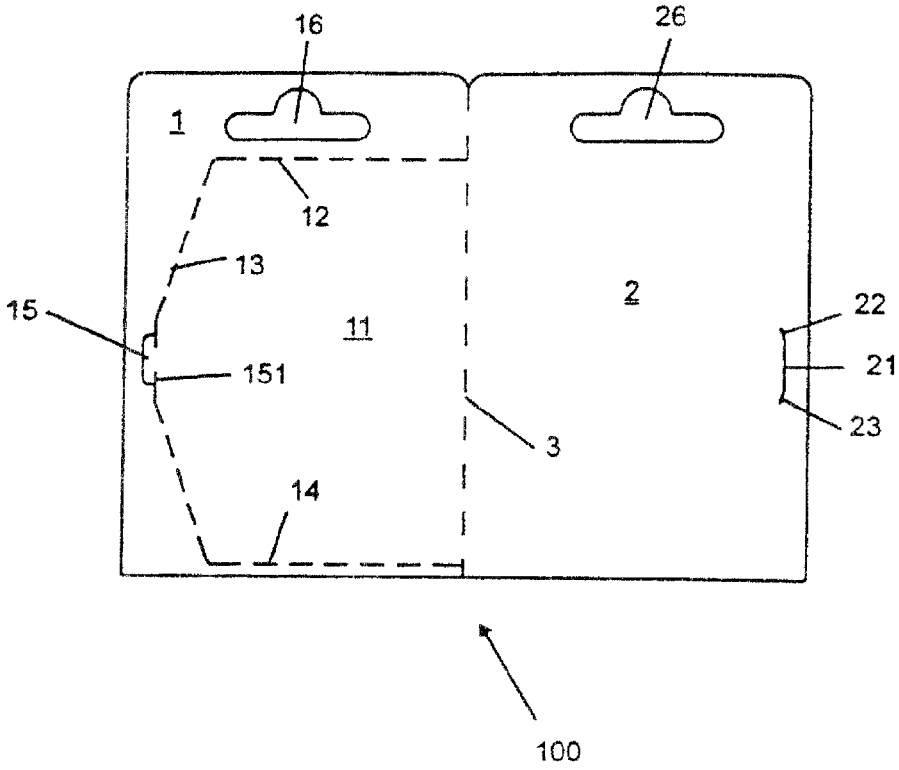

This invention relates to a recloseable dustproof pack with tamperproof seal which consists of cardboard, paperboard or a similar material and can be formed and filled mechanically. Furthermore, the pack is protected against theft.

DE 296 06 678 discloses a blister card which can be swung open and comprises two walls which are connected to one another, at least one spot of adhesive being provided on one of the two walls, and this spot of adhesive ensuring reversible closure of the blister card. In the case of this inventive subject matter, however, no products are to be stored in the resulting interior, nor is the adhesive bonding sealed such that the interior is dustproof.

DE 41 10 731 discloses a product pack comprising a card arrangement which is made up of a folding carrier card, a packaging card and a product-information carrier. The product is positioned on the packaging card preferably by means of a transparent film. The packaging card is secured against the carrier card from the rear, with the result that the product projects through a cutout located in the carrier card. In the case of this pack, which is intended predominantly for small products or small packaging quantities, reversible closure is not possible, and in addition the pack is formed from a mix of different materials, this rendering production of the pack more complicated and expensive and also restricting the desired recyclability to a very great extent.

The object of the invention is to provide a recloseable dustproof pack which serves for receiving low-thickness products and can be produced cost-effectively using as little material as possible.

This object, on which the invention is based, is achieved by the teaching of the main claim. The invention additionally comprises an alternative embodiment. Advantageous configurations of the embodiments are explained in the subclaims.

Accordingly, the first embodiment of the recloseable dustproof pack with tamperproof seal, which is intended for packaging low-thickness products and is formed from cardboard, paperboard or a similar material, comprises a front side wall and rear side wall which are essentially rectangular and have essentially the same dimensions. The front side wall and the rear side wall are arranged so as to be located one above the other, on a total of three sides the respective edge regions are adhesively bonded to one another by an adhesive coating being applied over their surfaces, and the front side wall and the rear side wall are connected to one another on the non-adhesively-bonded side via a folding line, this resulting in a pocket which is closed off towards the outside. Finally, provided in the front side wall is a flap which is articulated on the front side wall by means of a second folding line. The remaining edges are joined to the surrounding region of the front side wall by means of weakening lines. On the edge which is located opposite the second folding line, the flap preferably has at least one integrally formed tab which can engage in a correspondingly shaped punched cut in the rear side wall. Weakening lines are to be understood here as meaning, in particular, perforation lines or counter-scored lines.

Counter-scored lines, also referred to as counter-punched lines, are used for forming openings in surfaces on packs. For this purpose, incipient punches or scores are made in the material, in a manner offset from both sides and preferably at a spacing of approximately 1 mm to 3 mm, to half the material thickness (for example cardboard or paperboard). This results in a specific tearing away of the material between the two punched cuts or scores, with the result that said surfaces can easily be severed.

In one advantageous embodiment of the pack, the second folding line is integrated in the first folding line.

In a second embodiment of the idea of the invention, the recloseable dustproof pack with tamperproof seal, which is intended for packaging low-thickness products and is formed from cardboard, paperboard or a similar material, comprises a front side wall and rear side wall which are essentially rectangular and have essentially the same dimensions. Here too, the front side wall and the rear side wall are arranged so as to be located one above the other, but on all four sides the respective edge regions are adhesively bonded to one another by an adhesive coating being applied over their surfaces, this resulting in a pocket which is closed off towards the outside. Provided in the front side wall is a flap which is articulated on the front side wall by means of the second folding line and of which the remaining edges are joined to the surrounding region of the front side wall by means of weakening lines and which, preferably on the edge which is located opposite the second folding line, has at least one integrally formed tab which can engage in a correspondingly shaped punched cut in the rear side wall.

As an alternative to the tab/punched-cut closure system, it is also possible for one or more spots of adhesive to be provided on the flap, these permitting the flap to be opened and closed reversibly.

It has proven advantageous if the edge regions of the front side wall and of the rear side wall are coated with a cold-sealable or heat-sealable sealing medium and/or a hot-setting or cold-setting adhesive.

It has also proven advantageous if the products located in the pocket lie beneath an additional covering. This gives additional product protection. In order not to impair the barrier properties, the weakening lines for opening the flap must only be provided in the region of the material, and not in the region of the laminated barrier material.

The material for forming the front side wall and the rear side wall may have laminations for achieving a barrier property. Examples which may be mentioned here are barriers against water vapour, germs or oxygen. This addition results in a considerable increase in product protection in the pack.

Finally, in one preferred embodiment, the front side wall and the rear side wall each have a hanging means such as slots or round holes which are provided such that the hanging means are located one above the other.

The design of the pack according to the invention allows it to be used particularly advantageously for packaging plasters.

In addition, it is advantageous if the product quantities which are to be packaged are relatively small or if the products are relatively small.

There are a number of advantages in using the pack according to the invention:

- Extensive protection by full-surface-area sealing or adhesive bonding of the edge regions.
- Coating of the material results in an improved barrier function.
- Quick opening of the pack with easy access to the contents by way of a large flap which is fastened in the front side wall by means of perforation lines or counter-scored lines.
- Associated with this is easy removal of the product contained in the pack.
- The integrally formed grip, for example, ensures that the pack can be reclosed, said grip, for closure purposes, being inserted into the punched cut provided for this purpose in the rear side wall. This is achieved by slight pressure being exerted in the region of the punched cut on the rear surface of the rear side wall of the pack.

Appropriate coating of the material even allows the packed-product to be sterilized. The sterilized state is achieved by the full-surface-area sealing of the edge regions and the resulting barrier properties.

The pack according to the invention has outstanding properties, in particular, for the purpose of packaging plasters. In the case of the straightforward, adhesively bonded or sealed pack without additional product sealing in the interior, it is possible for example for individually sealed strips to be positioned one beneath the other in an imbricated manner without them being too bulky, this avoiding the situation where the carton is subjected to stressing after the sealing operation. Specific coating of the material (for example polyethylene) on the inner surfaces also makes it possible for individual plasters—even ones which have not been sealed—to be positioned in rows one beside the other on the two inner sides.

Furthermore, the pack is suitable for machines, that is to say it is possible, with full automation, for this pack to be adhesively bonded from the punched blank and filled with the desired product in an appropriately designed filling station and adhesively bonded. This results in a recloseable pack which protects the products located in the interior of the folding box against dust.

Figure 2:
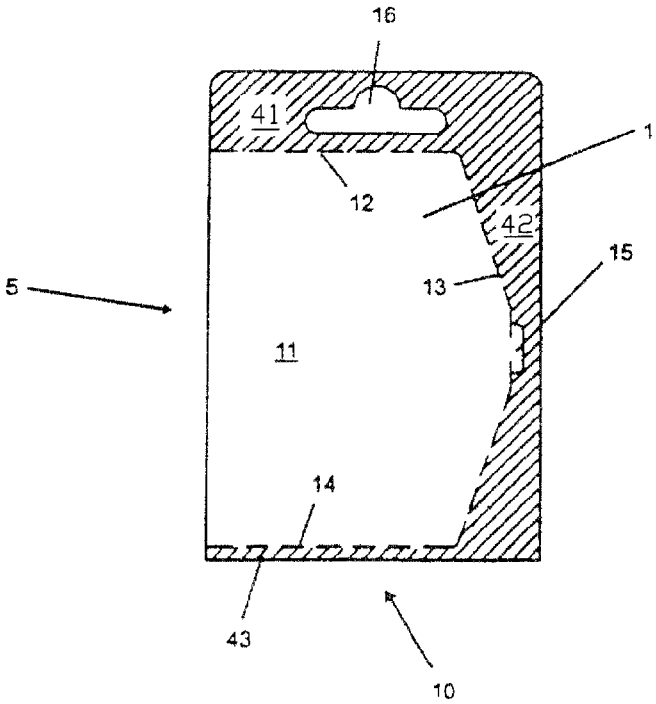
Figure 3:
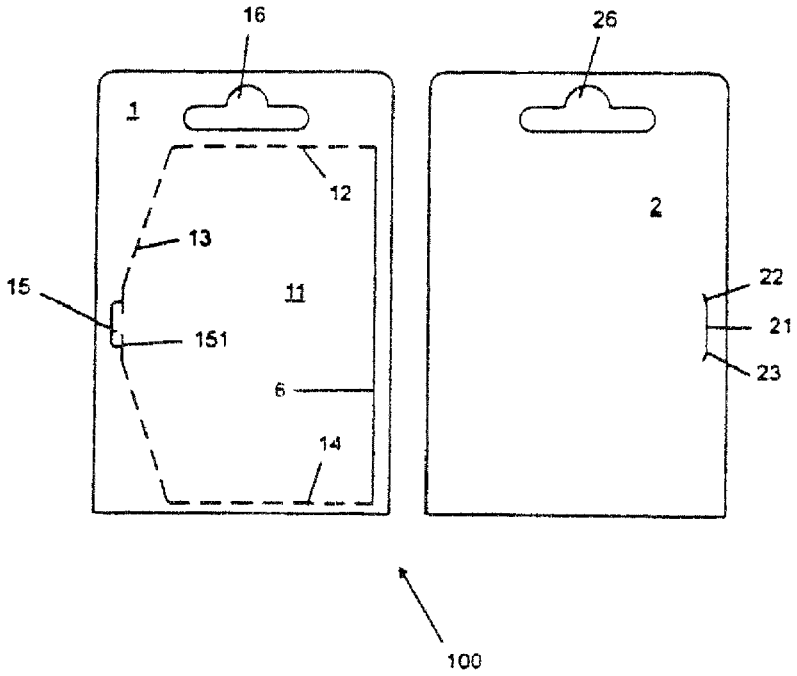

Two particularly advantageous embodiments of the pack, together with punched blanks, will be explained in more detail, without intending to restrict the invention unnecessarily, with reference to the Figures, which are described hereinbelow and in which:

FIG. 1 shows the flattened-out, non-adhesively-bonded punched blank of a particularly advantageously designed variant of the firs t embodiment of the pack, FIG. 2 shows the completed pack according to FIG. 1, the adhesively bonded edge regions being made to stand out, FIG. 3 the straightened-out, non- adhesively-bonded punched blank of a particularly advantageously designed variant of the second embodiment of the pack.

Figure 4:
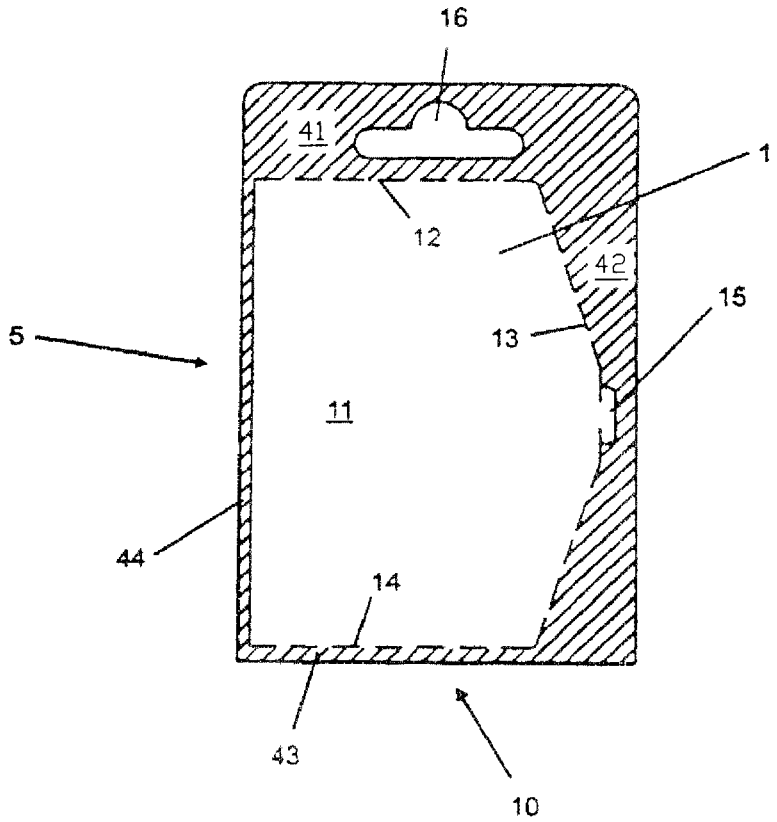
Figure 5:
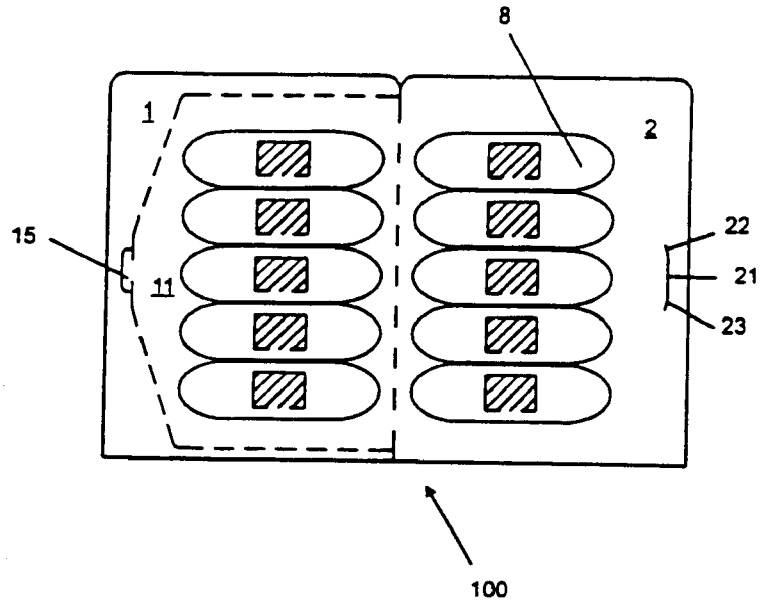
Figure 6:
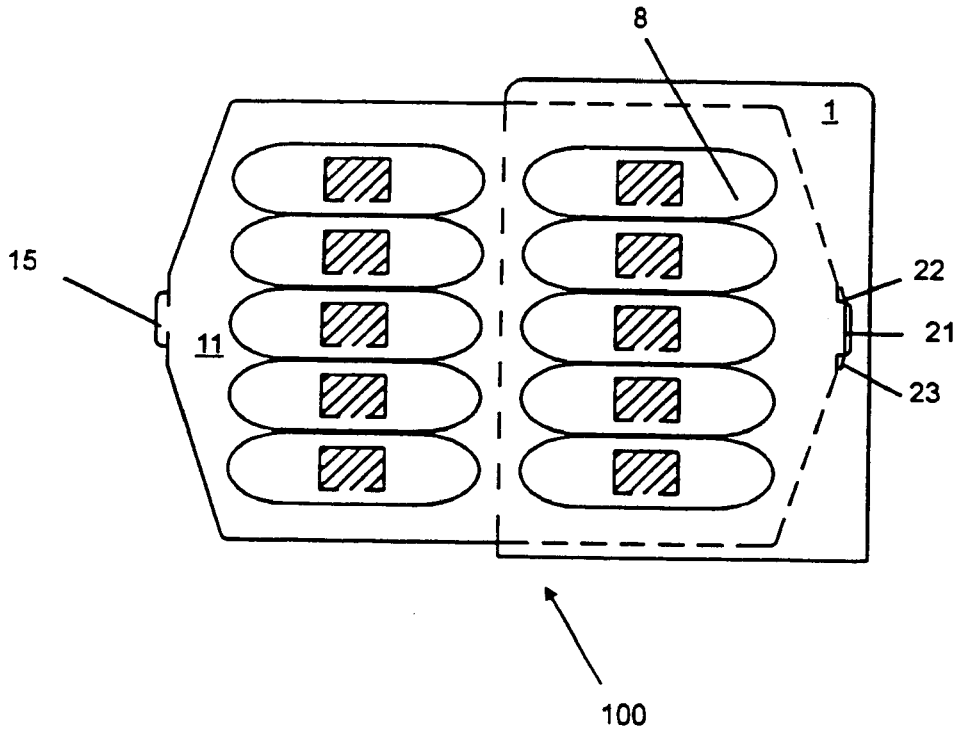
Figure 7:
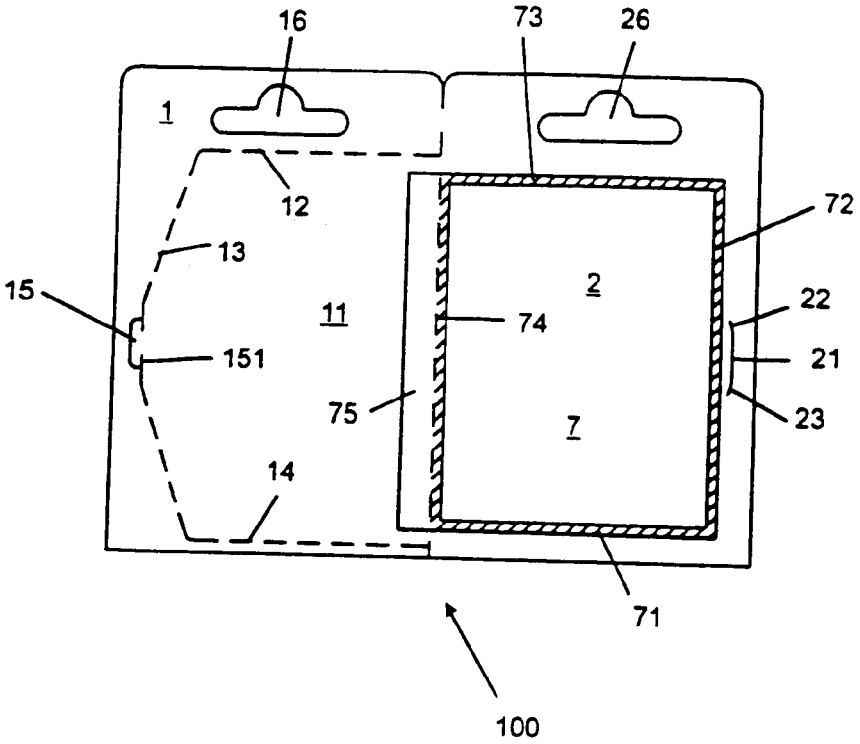
Figure 8:
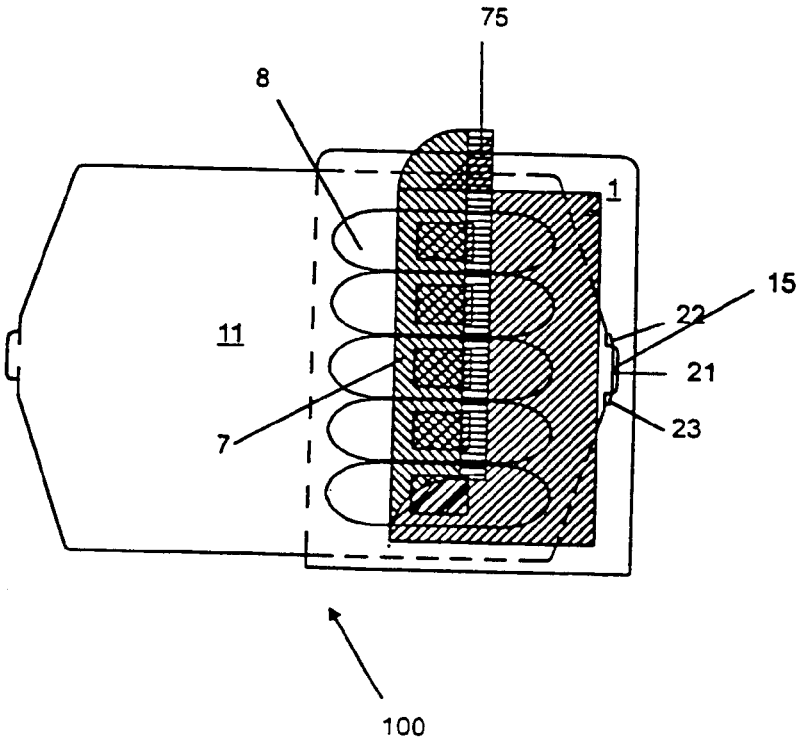

FIG. 4 shows the completed pack according to FIG. 3, the adhesively bonded edge regions being made to stand out, FIG. 5 shows the flattened-out, non-adhesively-bonded punched blank of the first embodiment of the pack, according to FIG. 1, with products, FIG. 6 shows the completed pack according to FIG. 5 with products, to be precise once the pack has been torn open, FIG. 7 shows the flattened-out, non-adhesively-bonded punched blank of the first embodiment of the pack, according to FIG. 1, with additional sealing paper for protecting the product, and FIG. 8 shows the completed pack according to FIG. 7 with additional sealing paper for protecting the product, to be precise during removal of the sealing paper.

FIG. 1 illustrates the flattened-out punched blank 100 of the first embodiment of the pack 10 according to the invention. The punched blank 100 is made up of the front side wall 1 and of the rear side wall 2, which are connected to one another via the folding line 3. The front side wall 1 and the rear side wall 2 have the same dimensions and are both rectangular. The flap 11 is integrated in the front side wall 1. The front side wall 1 and the flap 11 are connected, on the one hand, via the folding line 3 and, on the other hand, via a total of three perforation lines 12, 13, 14, which are punched into the front side wall 1. In order to open the flap 11, and thus the pack 10, for the first time, the perforation lines 12, 13, 14 are torn open. Since this tearing-open operation has to be irreversible, a tamperproof seal is provided as a result. Access to the pack contents is immediately detectable. In order to close the pack 10 once opened, a tab 15, which is punched into the front side wall 1 is also formed on the flap 11. The rectangular tab 15, which has rounded corners, is arranged on that edge of the flap 11 which is located opposite the folding line 3, to be precise in the centre of the perforation line 13, which tapers at an obtuse angle. On the long side, the tab 15 has a groove line 151, which allows improved reclosure. The pack 10, in the completed state, is closed by the tab 15 engaging in a correspondingly shaped punched cut 21 in the rear side wall 2 and hooking therein. The punched cut 21 has, preferably at both ends, a lateral lengthening cut 22, 23 which extends away from it. These permit easier insertion of the tab 15. In order for it to be possible for the pack 10 according to the invention to be displayed particularly advantageously in the known hanging racks provided with hooks, a total of two hanging means 16, 26, to be precise preferably a combination of slots and round holes, are punched centrally in each case in the top region of the front side wall 1 and of the rear side wall 2. When the front side wall 1 and the rear side wall 2 are located one above the other, the hanging means are arranged largely congruently. Furthermore, it has turned out to be advantageous if one of the two hanging means 16, 26 has slightly greater dimensions than the other, in order for it to be possible to compensate for unavoidable inaccuracies during punching of the punched blank 100 and/or completion of the pack 10. Finally, in the top region of the front side wall 1 and of the rear side wall 2, the total of four corners are rounded.

The punched blank 100 may be punched and perforated inline from a format-dependent roll; however, it may also be fed to the product in a pre-punched and pre-perforated state in the magazine of the cartoning machine.

FIG. 2 illustrates the completed pack 10 according to FIG. 1, to be precise with a view of the front side wall 1. The front side wall 1 is adhesively bonded to the rear side wall 2. The adhesive bonding takes place over three regions 41, 42, 43, adhesive being applied over the surfaces thereof (so-called three-edge sealing). The adhesive-containing regions 41, 42, 43 on the front side wall 1 largely correspond to the surface area which is not taken up by the flap 11 in the front side wall 1. This forms, beneath the flap 11, a dustproof pocket 5 which is suitable for receiving low-thickness products.

FIG. 3 shows the flattened-out punched blank 100 of the second embodiment of the pack 10 according to the invention, likewise in a particularly advantageous embodiment. The punched blank 100 of this pack 10 is largely identical to the punched blank 100 of the pack 10 from FIG. 1, but the front side wall 1 and the rear side wall 2 are not joined to one another via a folding line. Furthermore, the entire flap 11 is provided in the front side wall 1. For this purpose, the flap 11 is articulated on the folding line 6, which runs parallel to one of the outer edges of the front side wall 1. The other three edges of the flap 11 are, in turn, joined to the front side wall 1 via tear-open perforation lines 12, 13, 14. Then, the flap 11 also has formed on it a tab 15 which can engage in the correspondingly shaped punched cut 21 in the rear side wall 2.

FIG. 4 illustrates the completed pack 10 according to FIG. 3, to be precise with a view of the front side wall 1. The front side wall 1 is adhesively bonded to the rear side wall 2. The adhesive bonding takes place over four regions 41, 42, 43, 44, adhesive being applied over the surfaces thereof (so-called four-edge sealing). The adhesive-containing regions 41, 42, 43, 44 on the front side wall 1 largely correspond to the surface area which is not taken up by the flap 11 in the front side wall 1. This forms, beneath the flap 11, a dustproof pocket 5 which is suitable for receiving low-thickness products.

FIG. 5 shows the flattened-out punched blank 100 of the first embodiment of the inventive pack 10 according to FIG. 1. Products 8, in this case plasters, are fitted on the flap 11 in the front side wall 1. There is an equal number of plasters 8 on the rear side wall 2, to be precise in that region of the rear side wall 2 which is covered by the flap 11.

The inner sides of the front side wall 1 and of the rear side wall 2 are provided with slightly adhesive properties, in order thus to fasten the plasters 8 such that, on the one hand, they are stored in an ordered manner in the pocket 5 and, on the other hand, the user can easily draw them off the backing.

This method of product fastening is recommended if the perforation lines 12, 13, 14 are not punched through the coating of the inner surface of the front side wall 1.

FIG. 6 illustrates the completed pack 10 according to FIG. 5, said pack having products 8 covering it. The flap 11 has been torn open for removal of a plaster 8, all of a total of ten plasters 8 are provided in a clearly set-out arrangement, and the user can choose a specific plaster and remove it from the backing. This is important, in particular, if the pack 10 according to the invention is used to display different plasters or products.

FIG. 7 illustrates the flattened-out punched blank 100 of the pack 10 according to FIG. 1. Products 8 are stored in the pocket located beneath the flap 11 and, for protection against damage or soiling, are covered by an additional sheet of sealing paper 7, which has to be drawn off by way of the lateral projection 75 before access can be gained to the products for the first time. The sealing paper 7 is sealed onto the rear side wall 2 at all four edge regions 71, 72, 73, 74. The dimensions of the sealing paper 7 are adapted in this case to the dimensions of the flap 11.

FIG. 8 shows the completed pack 10 according to FIG. 5. The flap 11 has been torn open in order to allow access to the contents of the pack 10. The sealing paper 7, beneath which the products, in this case plasters, are located, is being drawn off the rear side wall 2 by the lateral projection 75.

What is claimed is:

1. Reclosable dustproof pack with tamperproof seal, which is intended for packaging low-thickness products and is formed from cardboard or paperboard, consisting essentially of a front side wall and rear side wall which are substantially rectangular and have substantially the same dimensions, the front side wall and the rear side wall being arranged so as to be located one above the other, on a total of three sides the respective edge regions are adhesively bonded to one another by having an adhesive coating applied over their surfaces, and the front side wall and the rear side wall are connected to one another on the non-adhesively-bonded side via a folding line, this resulting in a sealed pocket for low-thickness products which is closed off towards the outside, the front side wall being provided with a flap which is articulated on the front side wall by means of a second folding line and which is otherwise joined to the surrounding region of the front side wall by means of weakening lines, said flap providing the only access to said pocket without breaking said adhesive bonds or causing destruction to said pack so that a product stored in said pocket cannot be removed therefrom without detection.

2. Recloseable dustproof pack according to claim 1, wherein the second folding line is integrated in the first folding line.

3. Pack according to claim 1, wherein the edge regions of the front side wall and of the rear side wall are coated with one of the group consisting of a cold-sealable sealing medium, a heat-sealable sealing medium, a hot-setting adhesive, and a cold-setting adhesive.

4. Pack according to claim 1, further comprising a protective lining attached to at least one of said walls.

5. Pack according to claim 1, wherein the material for forming the front side wall and the rear side wall has laminations for achieving a barrier property.

6. Pack according to claim 1, wherein the front side wall and the rear side wall each have slots or holes which are provided such that they are located one above the other and adapted to be used for hanging said pack on a display.

7. A method for the dustproof, tamperproof and resealable packaging of plasters, which comprises packaging said plasters in the reclosable dustproof pack of claim 1.

8. Reclosable dustproof pack with tamperproof seal, which is intended for packaging low-thickness products and is formed from cardboard or paperboard, consisting essentially of a front side wall and rear side wall which are substantially rectangular and have substantially the same dimensions, the front side wall and the rear side wall being arranged so as to be located one above the other, and on all four sides the respective edge regions are adhesively bonded to one another by an adhesive coating being applied over their surfaces, this resulting in a pocket for low-thickness products which is closed off towards the outside, the front side wall being provided with a flap which is articulated on the front side wall by means of a folding line and which is otherwise joined to the front side wall by means of weakening lines said flap providing the only access to said pocket without breaking said adhesive bonds or causing destruction to said pack so that a product stored in said pocket cannot be removed therefrom without detection.

9. Pack according to claim 1, wherein, the flap is provided with at least one integrally formed tab which can engage in a correspondingly shaped punched cut in the rear side wall.

10. Pack according to claim 3, wherein the flap has at least one integrally formed tab which can engage in a correspondingly shaped punched cut in the rear side wall.

11. Pack according to claim 3, wherein the edge regions of the front side wall and the rear side wall are coated with one of the group consisting of a cold-sealable sealing medium, a heat-sealable sealing medium, a hot-setting adhesive, and a cold-setting adhesive.

12. Pack according to claim 3, further comprising a protective lining attached to at least one of said walls.

13. Pack according to claim 3, wherein the material for forming the front side wall and the rear side wall has laminations for achieving a barrier property.

14. Pack according to claim 3, wherein the front side wall and the rear side wall each have slots or holes which are provided such that they are located one above the other and adapted to be used for hanging said pack on a display.

15. A method of packaging plasters, which comprises packaging said plasters in the reclosable dustproof pack of claim 3.

* * * * *